US006481814B2

(12) United States Patent
DeMoor et al.

(10) Patent No.: US 6,481,814 B2
(45) Date of Patent: Nov. 19, 2002

(54) APPARATUS AND METHOD FOR INK JET PRINTHEAD VOLTAGE FAULT PROTECTION

(75) Inventors: Mark Kevin DeMoor, Nicholasville, KY (US); Todd Alan Dutton, Lexington, KY (US)

(73) Assignee: Lemark International, Inc., Lexington, KY (US)

( * ) Notice: Subject to any disclaimer, the term of this patent is extended or adjusted under 35 U.S.C. 154(b) by 0 days.

(21) Appl. No.: 09/795,249

(22) Filed: Feb. 28, 2001

(65) Prior Publication Data

US 2002/0118234 A1 Aug. 29, 2002

(51) Int. Cl.[7] ..... B41J 29/38
(52) U.S. Cl. ..... 347/5; 347/19
(58) Field of Search ..... 361/90, 18; 347/5, 347/19

(56) References Cited

U.S. PATENT DOCUMENTS

| | | | | |
|---|---|---|---|---|
| 4,439,776 A | | 3/1984 | Zeiler | |
| 4,594,501 A | | 6/1986 | Culley et al. | |
| 4,685,020 A | * | 8/1987 | Driscoll et al. | 361/18 |
| 4,769,657 A | | 9/1988 | Takahashi | |
| 4,774,526 A | | 9/1988 | Ito | |
| 4,812,673 A | | 3/1989 | Burchett | |
| 4,825,102 A | | 4/1989 | Iwasawa et al. | |
| 4,841,220 A | * | 6/1989 | Tabisz et al. | 323/282 |
| 4,897,557 A | | 1/1990 | Krause | |
| 4,907,013 A | | 3/1990 | Hubbard et al. | |
| 4,951,171 A | * | 8/1990 | Tran et al. | 361/90 |
| 5,362,161 A | | 11/1994 | Nagano | |
| 5,371,530 A | | 12/1994 | Hawkins et al. | |
| 5,469,068 A | | 11/1995 | Katsuma | |
| 5,585,814 A | | 12/1996 | Ueno et al. | |
| 5,736,997 A | | 4/1998 | Bolash et al. | |
| 5,793,245 A | | 8/1998 | Marshall et al. | |
| 5,852,369 A | | 12/1998 | Katsuma | |
| 5,890,819 A | | 4/1999 | Compton | |
| 5,951,175 A | | 9/1999 | Kawamori | |

FOREIGN PATENT DOCUMENTS

| | | |
|---|---|---|
| JP | 61265628 A | 11/1986 |
| JP | 62050180 A | 3/1987 |
| JP | 07299943 A | 11/1995 |

* cited by examiner

*Primary Examiner*—John Barlow
*Assistant Examiner*—Julian D. Huffman
(74) *Attorney, Agent, or Firm*—Ronald K. Aust; Jacqueline M. Daspit

(57) ABSTRACT

An ink jet printhead voltage fault protection apparatus includes a power supply and a latching circuit. The latching circuit disables a printhead voltage applied to the printhead by the power supply upon detection of a fault condition associated with the printhead voltage such that the printhead voltage remains disabled until the power supply goes through a power-on reset sequence.

24 Claims, 5 Drawing Sheets

APPARATUS AND METHOD FOR INK JET PRINTHEAD VOLTAGE FAULT PROTECTION

BACKGROUND OF THE INVENTION

1. Field of the Invention

The present invention relates to a method and apparatus for voltage fault protection, and, more particularly, to a method and apparatus for voltage fault protection for an ink jet printhead.

2. Description of the Related Art

It is known for a switching voltage regulator to use some form of fault protection to prevent outputting the wrong voltage, sourcing too much current, and/or over-stressing individual electrical components. However, many forms of fault protection simply shut down the switching voltage regulator while the fault exists. Therefore, if the switching voltage regulator shuts down due to a fault condition, and the fault does not go away, then the switching voltage regulator starts to supply voltage and current again until the fault is redetected. The result is that the switching voltage regulator continues to cycle on and off until the input supply voltage ($V_{13}$ Bulk) is removed. The buck regulator circuit 10 of FIG. 1, including an over-current protection circuit 11 and a converter 12, illustrates a known fault detection method used on switching voltage regulators in which the above-described problems exist. Over-current protection circuit 11 includes a pulse width modulation controller 13 and an external sense-resistor 14. Regulator 10 is also known as a switch-mode power supply.

In order to provide current-overload protection, external sense-resistor 14 is connected between the input supply voltage ($V_{13}$ Bulk) of pulse width modulation controller 13 and the drain of a load-carrying field effect transistor (FET) 16. Resistor 14 senses the output current $i_0$ of pulse width modulation controller 10 at node ($V_{13}$ OUT). The voltage across sense-resistor 14 is fed back to an $RSENSE_{13}$ VPH pin 18. If $RSENSE_{13}$ VPH pin 18 reads a voltage exceeding a voltage-trip level, then regulator 10 senses a fault condition and momentarily shuts down the output voltage ($V_{13}$ OUT) and current of regulator 10 by turning off the cycling of a pulse width modulated signal driving the gate of load-carrying FET 16 on pin 20. By applying no voltage to pin 20 and to the gate of FET 16, pulse width modulation controller 13 turns off FET 16. Regulator 10 re-starts after a fixed time period until the fault condition again causes $RSENSE_{13}$ VPH pin 18 to exceed a voltage trip level. This current limiting behavior continues, and the output voltage ($V_{13}$ OUT) drops to an unregulated under voltage condition, until the fault condition is removed. An inductor 22 and a capacitor 24 form a filter to transform a switching (alternating current) voltage on $VPH_{13}$ SOURCE pin 26 into a direct current voltage at ($V_{13}$ OUT). The switching voltage on $VPH_{13}$ SOURCE pin 26 is a pulse width modulated source signal which switches between voltages of $V_{13}$ Bulk and ground. Diode 28 is a fly-back diode.

What is needed in the art is a voltage and current fault protection circuit for an ink jet printhead that permanently disables the printhead voltage once a fault has been detected.

SUMMARY OF THE INVENTION

The present invention provides self-clocking, self-initializing and self-monitoring for over-voltage and under-voltage fault conditions, with a latched fault output signal, for a printhead of an ink jet printer.

The present invention comprises, in one form thereof, an ink jet printhead voltage fault protection apparatus including a power supply and a latching circuit. The latching circuit disables a printhead voltage applied to the printhead by the power supply upon detection of a fault condition associated with the printhead voltage such that the printhead voltage remains disabled until the power supply goes through a power-on reset sequence.

The present invention comprises, in another form thereof, a method of protecting an ink jet printhead from a voltage fault condition and from an over-current fault condition which can cause overheating. The method includes applying a printhead voltage from a power supply to the ink jet printhead. A fault condition associated with the printhead voltage is detected. The printhead voltage is disabled dependent upon the detecting step such that the printhead voltage remains disabled until the power supply is cycled off and then on again.

The latched fault output signal disables the printhead voltage, once a fault has been detected, until the printer goes through a power-on reset sequence. A clocked latch for noise immunity uses a signal derived from a square wave output from the switch-mode power supply for self-clocking and proper shutdown during faults. A self-initializing feature prevents false shutdown during turn-on transients.

The present invention provides an apparatus and method by which an over-voltage and under-voltage fault condition, detected at the output of a switch-mode power supply, results in the permanent disablement of the output. Also, an over-current fault condition is detected when the current limit of the buck regulator results in an under voltage fault condition. This is accomplished by latching the detection of the fault condition until the regulator goes through a power-on reset sequence. The over-voltage and under-voltage protection circuitry is self-clocking by using a switching voltage from the switch-mode power supply to clock in a fault condition to a D-flip-flop, self-initializing through a power-on reset sequence, and self-monitoring during the operation of the switching voltage regulator. The present invention combines the benefits of a clocked latch, for immunity to spurious noise, with a self-clocking feature that is a novel way of disabling the clock for proper latching of fault conditions.

The present invention provides a method by which an over-voltage or under-voltage fault condition, detected on the output of a switch-mode power supply, permanently disables the output by latching the detection of the fault condition until the regulator goes through a power-on reset sequence. The over-voltage and under-voltage protection circuitry is self-clocking by using a switching voltage from the switch-mode power supply to clock-in a fault condition to the D-flip-flop, self-initializing through a power-on reset sequence, and self-monitoring during the operation of the switching voltage regulator. The described method also properly latches off the output of a switching voltage regulator when the over-voltage and under-voltage fault detection circuit is powered-on into a fault condition.

An advantage of the present invention is that the printhead voltage is permanently disabled, instead of cycling on and off, while operating in current limit mode, after a voltage fault has been detected.

Another advantage is that the present invention properly handles power on when a fault condition is present.

Yet another advantage is that voltage transients resulting from turning on the power supply are not interpreted as a voltage fault condition.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
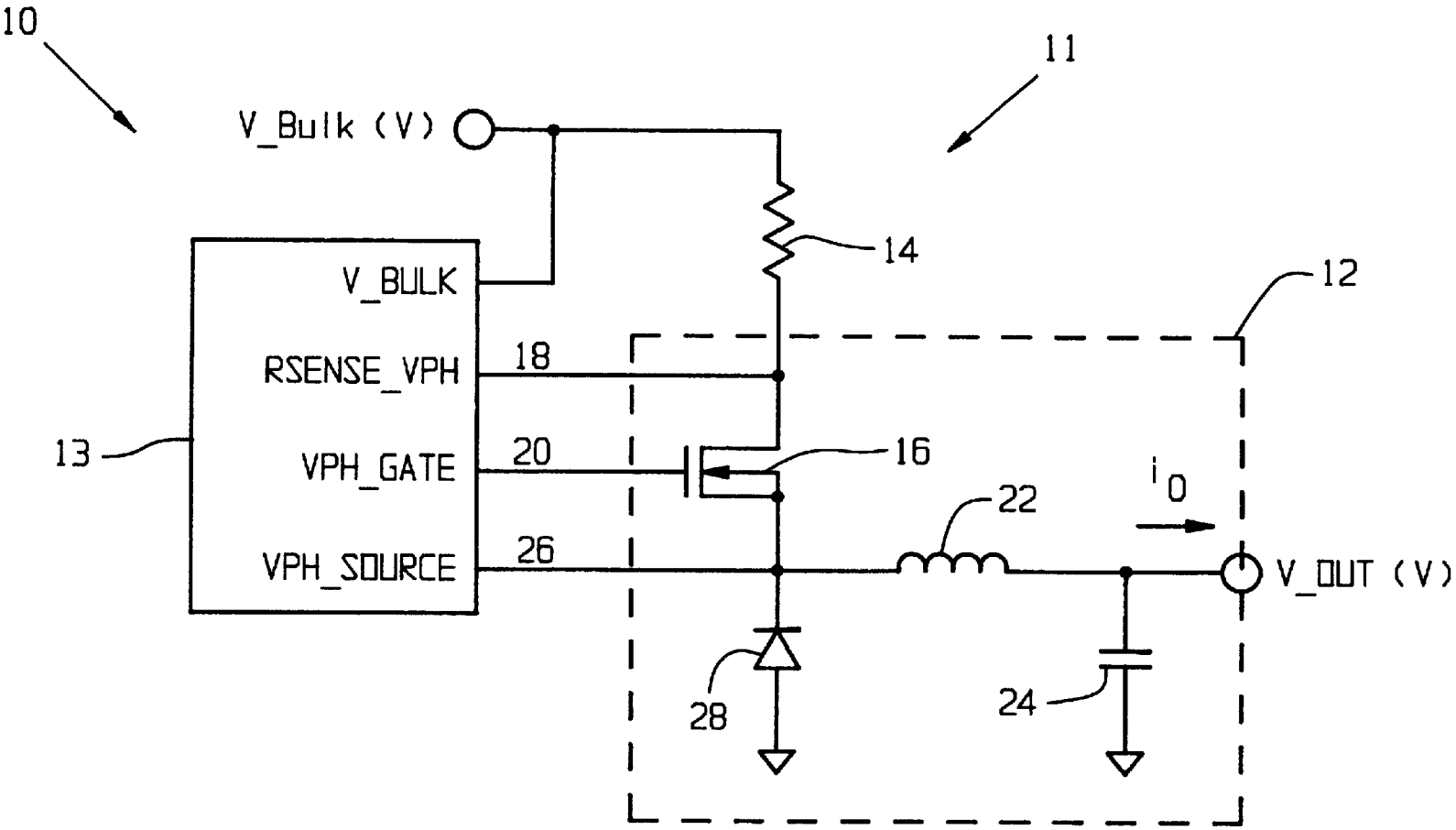
Prior Art Fig. 1
FIG. 1 is a block diagram of a known configuration of a buck-regulator with an over-current protection circuit.
Figure 2:
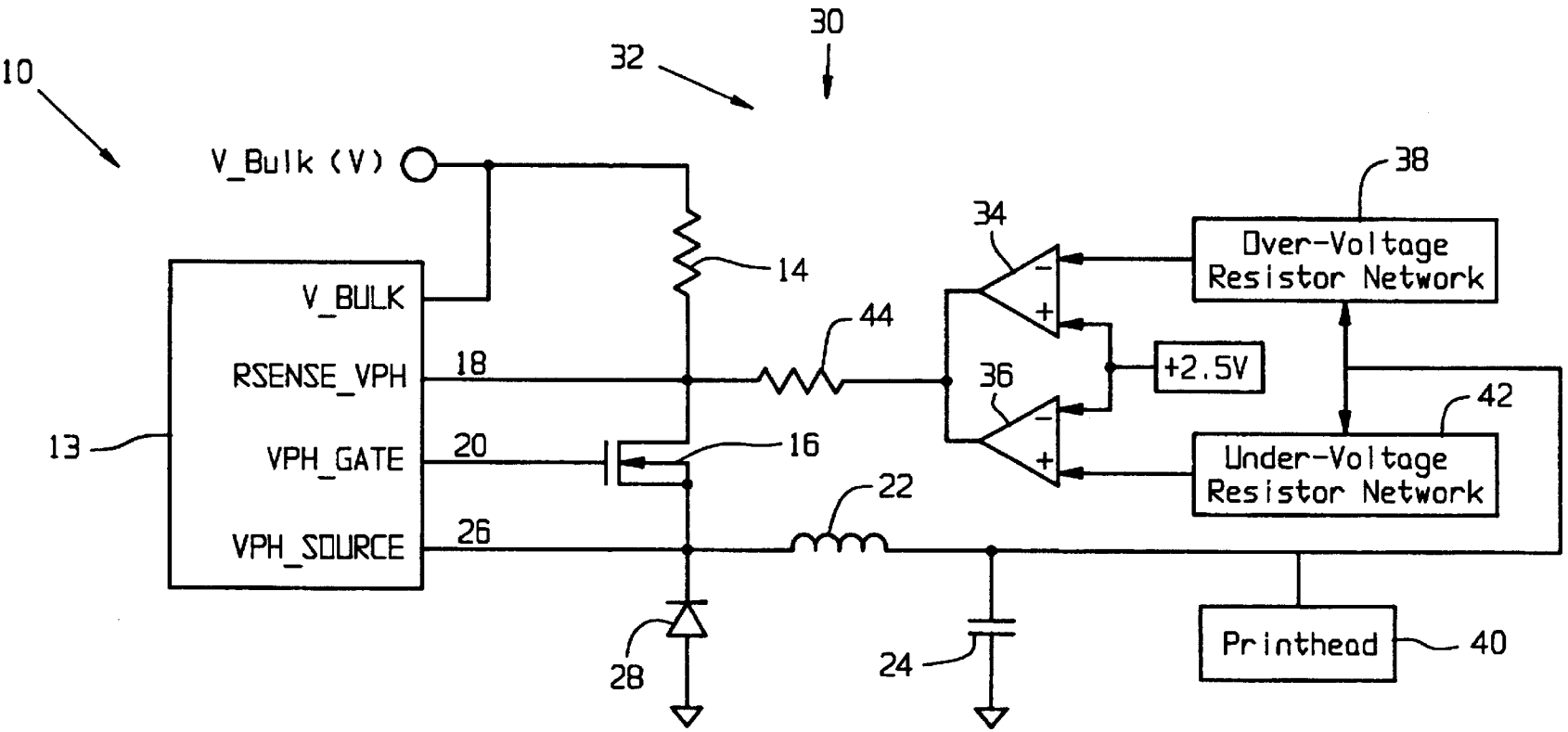
FIG. 2 is one embodiment of an ink jet printhead voltage fault protection circuit of the present invention.

Referring now to FIG. 2, a voltage fault protection circuit 30 includes buck regulator 10 and a non-latching over-voltage and under-voltage detection circuit 32. Two open-collector/drain comparators 34 and 36 each have a predetermined trip-level voltage (+2.5V) applied to one of two inputs. The other input of comparator 34 is connected through a resistor-divider network 38 to the output voltage of switching voltage regulator 10, which is also applied to a printhead 40. Resistor-divider network 38 is configured to sense an over-voltage condition. The remaining input of comparator 36 is connected to the output voltage of switching voltage regulator 10 through a second resistor-divider network 42 for sensing an under-voltage condition.

The outputs of comparators 34, 36 are logically OR'd together and are fed to the $RSENSE_{13}$ VPH pin 18 through a properly sized resistor 44. If an over-voltage or under-voltage condition exists, then one of comparators 34, 36 will cause the $RSENSE_{13}$ VPH pin 18 to read a voltage level exceeding the trip-level voltage. At that time, pulse width modulation controller 13 senses a fault condition and shuts down the output voltage and current to printhead 40 by turning off the pulse width modulated voltage on pin 20 that drives the gate of load-carrying field effect transistor 16.

Figure 3:
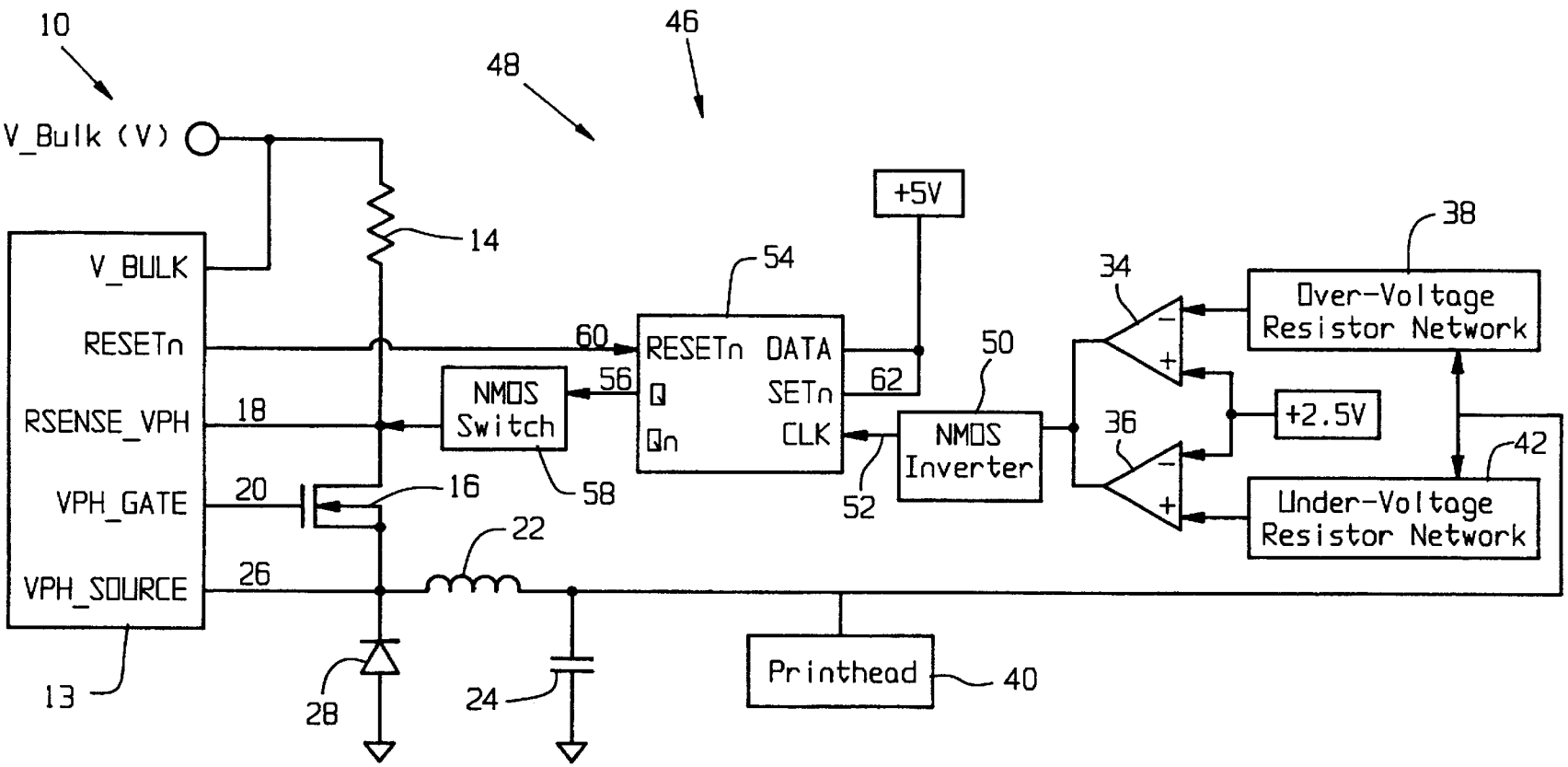
FIG. 3 is another embodiment of an ink jet printhead voltage fault protection circuit of the present invention.

In another embodiment (FIG. 3), a voltage fault protection circuit 46 includes buck regulator 10 and a latching over-voltage and under-voltage detection circuit 48. Circuit 48 latches the fault condition to prevent switching voltage regulator 10 from cycling on and off until the input supply voltage $V_{13}$ Bulk is removed. Circuit 48 also self-initializes through a power-on reset.

Two Open-Collector/Drain Comparators 34, 36 each have a predetermined trip-level voltage (+2.5V) applied to one of two inputs. The other input of comparator 34 is connected through resistor-divider network 38 to the output voltage of switching voltage regulator 10, which is also applied to printhead 40. Resistor-divider network 38 is configured to sense an over-voltage condition. The remaining input of comparator 36 is connected to the output voltage of switching voltage regulator 10 through second resistor-divider network 42 for sensing an under-voltage condition.

The outputs of comparators 34, 36 are logically OR'd together and are fed, through an inverter 50 to a clock pin 52 of a D-flip-flop 54. A Q output pin 56 of D-flip-flop 54 is fed to the gate of an NMOS switch 58, which has its drain connected to the $RSENSE_{13}$ VPH pin 18 through a resistor-divider network (not shown). If an over-voltage or under-voltage condition exists, then one of comparators 34, 36 will clock and latch a fault condition to Q output 56 of D-flip-flop 54, thereby causing NMOS switch 58 to turn-on. This, in turn, causes $RSENSE_{13}$ VPH pin 18 to read a voltage level exceeding the trip-level voltage. At that time, regulator 10 senses a fault condition and shuts down the output voltage and current to printhead 40 by turning off the pulse width modulated voltage on pin 20 that drives the gate of load-carrying field effect transistor 16.

Circuit 46 self-initializes by feeding a reset "not" signal into a RESETn pin 60 of D-flip-flop 54 and having a SETn pin 62 of D-flip-flop 54 permanently connected to a logic "high". If circuit 46 is powered-on into an over-voltage or under-voltage fault condition, then clock pin 52 of D-flip-flop 54 will not detect the rising-edge from inverter 50 due to D-flip-flop 54 being in a reset-state. Thus, the fault condition will not be detected.

Figure 4:
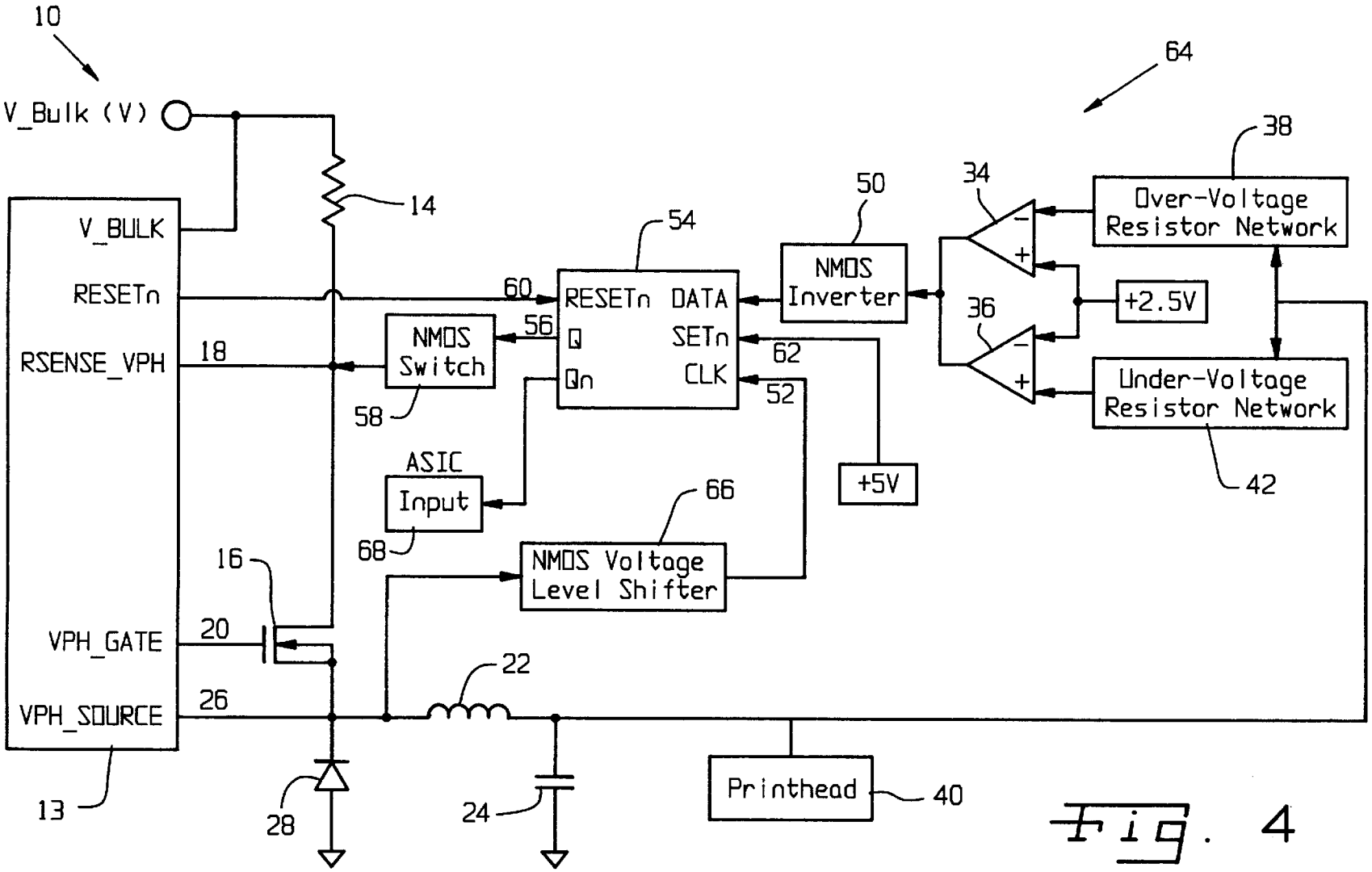
FIG. 4 is yet another embodiment of an ink jet printhead voltage fault protection circuit of the present invention.

Yet another embodiment (FIG. 4) provides a method by which an over-voltage or under-voltage fault condition, detected on the output of switching voltage regulator 10, results in the permanent disablement of the output of switching voltage regulator 10. This is accomplished by latching the detection of the fault condition until regulator 10 goes through a power-on reset sequence. This embodiment also properly latches off the output of switching voltage regulator 10 when the voltage fault protection circuit 64 is powered-on into a fault condition.

Voltage fault protection circuit 64 permanently disables the output of switching voltage regulator 10 by latching the detection of the fault condition until regulator 10 goes through a power-on reset sequence, and also detects an over-voltage or under-voltage fault if powered-on into a fault condition. Voltage fault protection circuit 64 includes comparators 34, 36, an NMOS transistor acting as an inverter 50, a D-flip-flop latch 54, a buck regulator 10, and another NMOS transistor used as a switch 58. Comparator 34 switches to a logic "low" if the output voltage of switching voltage regulator 10, which is applied to printhead 40, is greater than +12.3 Volts. Comparator 36 switches to a logic "low" if the voltage applied to printhead 40 is less than +8.8 Volts. Both the over-voltage and under-voltage "trip" levels are set by resistor-divider networks 38, 42 and may be set to different voltage values, depending on the application, than the values provided herein.

The outputs of the two comparators 34, 36 are OR'd together by the open-collector outputs of comparators 34, 36. Then, the OR'd outputs of comparators 34, 36 are inverted by NMOS transistor 50 and fed into the DATA input of D-flip-flop 54. The clock input of D-flip-flop 54 is controlled by the $VPH_{13}$ SOURCE signal of regulator 10 through a resistor network (not shown) and an NMOS transistor 66 acting as a voltage level shifter. The input to level shifter 66 is the pulse width modulated square wave drive of switch-mode power supply 10. This input signal switches between voltage levels of $V_{13}$ Bulk and ground. The output from shifter 66 is a pulse width modulated signal which switches between the Vcc of D-flip-flop 54 (+5V) and ground.

Upon a fault, D-flip-flop 54 clocks a logic "high" to its Q output and a logic "low" to its "Qn" output. The D-flip-flop's "Q" output activates NMOS Transistor 58, which pulls the RSENSE VPH pin 18 to the pin's fault-level voltage through a resistor network (not shown). Consequently, the output-voltage applied to printhead 40 is shut down by turning off field effect transistor 16 by removing the pulse width modulated signal applied to the gate on pin 20, which also stops the $VPH_{13}$ SOURCE pin 26 from outputting a pulse width modulated clock signal to the clock input on pin 52 of D-flip-flop 54. Once the pulse width modulated output from $VPH_{13}$ SOURCE has stopped, then the logic "high" state on the "Q" output of D-flip-flop 54 is latched, and no more clock pulses can be generated. This insures that clocking in a logic 'high' when the voltage applied to printhead 40 is transitioning from an over-voltage state to an under-voltage state during shutdown does not reset the latch. Also, the D-flip-flop's "Qn" output is latched and alerts a microcontroller (not shown) of a fault condition by the microcontroller reading the value of an input pin of an application specific integrated circuit 68.

The initial state of D-flip-flop 54 is set, during the power-on reset, by the SETn pin 62 of D-flip-flop 54 being connected to +5V (Vcc) and the RESETn pin 60 of D-flip-flop 54 being connected to the RESETn (Reset "not") output of regulator 10. Alternatively, it is possible for an external reset-circuit or microprocessor supervisor to supply the RESETn signal. The RESETn input is used to insure that initial start-up under-voltage or over-voltage transient conditions are not latched as a fault.

Figure 5:
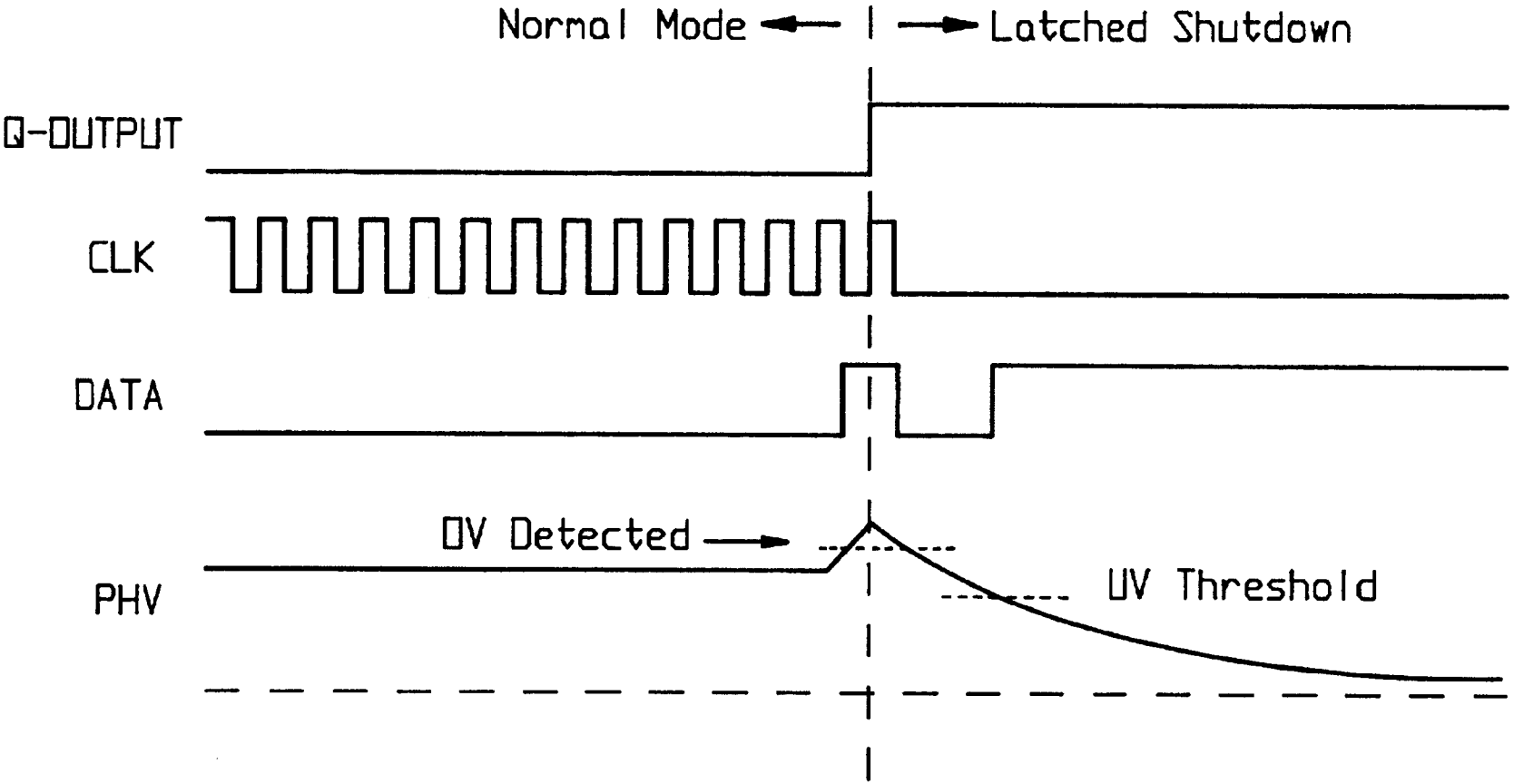
FIG. 5 is a timing diagram of voltages in the circuit of FIG. 4.

A timing diagram for a typical over-voltage fault condition is shown in FIG. 5. As illustrated, the $VPH_{13}$ SOURCE (CLK) is disabled as a result of the $RSENSE_{13}$ VPH pin 18 being pulled down to its fault-level voltage by the NMOS switch 58, which prevents regulator 10 from re-starting when the voltage output drops into a valid voltage region between the over-voltage threshold and the under-voltage threshold. In FIG. 5, Q-OUTPUT is the Q output of D-flip-flop 54, CLK is the output of NMOS voltage level shifter 66, DATA is the "DATA" input of D-flip-flop 54, and PHV is the voltage applied to printhead 40 by switching-mode regulator 10.

The switching voltage regulator has been shown in the embodiments herein in the form of a buck regulator. However, it is to be understood that other types of switching voltage regulators may also be used in implementing the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printhead voltage fault protection apparatus, comprising:

a power supply configured to supply a clocking signal; and a fault condition detection device for detecting a fault condition associated with a printhead voltage applied to the printhead by said power supply;

a latching circuit configured to receive said clocking signal and disable said printhead voltage upon detection of said fault condition associated with said printhead voltage, such that said printhead voltage remains disabled until said power supply goes through a power-on reset sequence.

2. The apparatus of claim 1, wherein said fault condition comprises at least one of a voltage fault condition and an over-current fault condition.

3. The apparatus of claim 2, wherein said voltage fault condition comprises said printhead voltage being one of less than a first threshold voltage and greater than a second threshold voltage.

4. The apparatus of claim 1, wherein said latching circuit is configured to detect whether said fault condition is present when said power supply is turned on.

5. The apparatus of claim 4, wherein said latching circuit is configured to disable said printhead voltage if said power supply is turned on into a fault condition.

6. The apparatus of claim 4, wherein said latching circuit is configured to not disable said printhead voltage if said fault condition results from transient voltages occurring when said power supply is turned on.

7. The apparatus of claim 1, wherein said power supply comprises a switchmode power supply.

8. The apparatus of claim 7, wherein said latching circuit includes a flip-flop.

9. The apparatus of claim 8, wherein said flip-flop comprises a D-flip-flop.

10. The apparatus of claim 8, wherein said apparatus is self-initializing though a power-on reset sequence.

11. The apparatus of claim 8, wherein said power supply is configured to transmit a reset signal to said flip-flop.

12. The apparatus of claim 8, wherein said flip-flop is configured to disable an output voltage of said power supply upon detection of the fault condition associated with said printhead voltage such that said output voltage remains disabled until said power supply goes through a power-on reset sequence.

13. The apparatus of claim 7, further comprising a filtering circuit configured to convert a switching voltage from said switch-mode power supply into a direct current voltage applied to the printhead.

14. A method of protecting an ink jet printhead from a fault condition, said method comprising the steps of:

providing a power supply;

providing a latching circuit;

applying a printhead voltage from said power supply to the ink jet printhead;

detecting a fault condition associated with said printhead voltage;

transmitting a clocking signal from said power supply to said latching circuit; and using said latching circuit to disable said printhead voltage dependent upon said detecting step such that said printhead voltage remains disabled until said power supply goes through a power-on reset sequence.

15. The method of claim 14, wherein said fault condition comprises at least one of a voltage fault condition and an over-current fault condition.

16. The method of claim 15, wherein said voltage fault condition comprises said printhead voltage being one of less than a first threshold voltage and greater than a second threshold voltage.

17. The method of claim 15, wherein said power supply comprises a switch-mode power supply.

18. The method of claim 17, comprising the further step of receiving said clocking signal with a latching device, at least one of said power supply and said latching device performing said disabling step.

19. The method of claim 18, comprising the further step of initializing at least one of said power supply and said latching device though a power-on reset sequence.

20. The method of claim 17, wherein said applying step includes converting a switching voltage from said switch-mode power supply into a direct current voltage applied to the printhead.

21. The method of claim 14, wherein said detecting step includes detecting whether said voltage fault condition is present when said power supply is turned on.

22. The method of claim 21, wherein said disabling step includes disabling said printhead voltage if said power supply is turned on into a fault condition.

23. The method of claim 21, wherein said printhead voltage is not disabled if said fault condition results from transient voltages occurring when said power supply is turned on.

24. The method of claim 14, wherein said power-on reset sequence comprises cycling said power supply off and then on again.

* * * * *